United States Patent [19]

Jimenez et al.

[11] Patent Number: 4,646,665

[45] Date of Patent: Mar. 3, 1987

[54] COVER FOR A LOOP CATCH MECHANISM OF A SEWING MACHINE

[75] Inventors: Antonio Jimenez, Meyrin; Pierre-Maurice Rochat, Châtelaine, both of Switzerland

[73] Assignee: Mefina S.A., Switzerland

[21] Appl. No.: 766,694

[22] Filed: Aug. 19, 1985

[30] Foreign Application Priority Data

Sep. 4, 1984 [CH] Switzerland ..... 4304/84

[51] Int. Cl.[4] ..... D05B 57/00; D05B 73/12

[52] U.S. Cl. ..... 112/260; 112/231; 108/141

[58] Field of Search ..... 112/260, 168, 13, 14, 112/258, 231; 108/138, 139, 141

[56] References Cited

U.S. PATENT DOCUMENTS

| | | | |
|---|---|---|---|
| 2,569,091 | 9/1951 | Casas Robert | 112/260 |
| 2,723,638 | 11/1955 | Bell | 112/260 |
| 2,770,207 | 11/1956 | Hess | 112/260 |
| 2,808,797 | 10/1957 | Aynes | 112/260 |
| 2,877,728 | 3/1959 | Enos | 112/260 |
| 3,060,878 | 10/1962 | Johnson | 112/260 |
| 3,071,091 | 1/1963 | Enbland | 112/260 |
| 3,440,987 | 4/1969 | Coulombe | 112/260 |
| 3,530,812 | 9/1970 | Rouha | 112/258 |
| 4,493,280 | 1/1985 | Bianchi | 112/260 |

FOREIGN PATENT DOCUMENTS

| | | | |
|---|---|---|---|
| 740831 | 9/1943 | Fed. Rep. of Germany | 112/260 |
| 738724 | 12/1932 | France . | |

*Primary Examiner*—Werner H. Schroeder
*Assistant Examiner*—Andrew M. Falik

[57] ABSTRACT

A displaceable cover for the housing of a sewing machine loop catch mechanism comprises a plate fixed to a pin which in turn is rotatably and slidably mounted in relatively fixed bearings. A spring element exerts upon the pin both a torsion torque and downward axial thrust. Opening of the cover is accomplished by depressing one end of a pivoted lever to cause the other end thereof to raise the cover from engagement within the housing and allowing the spring elements to swing the cover into an open position.

8 Claims, 5 Drawing Figures

FIG.1
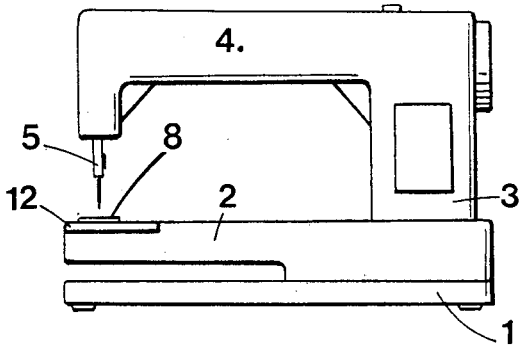
FIG.2
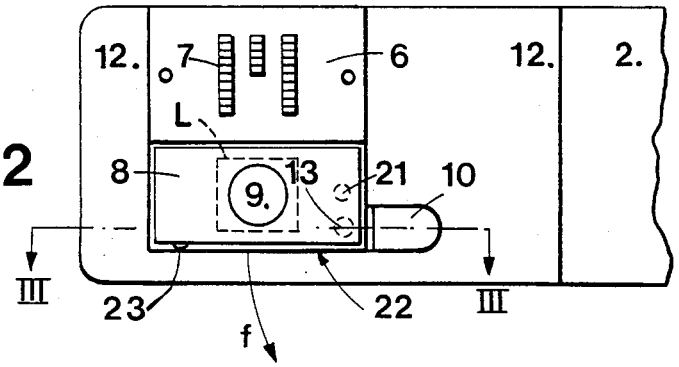
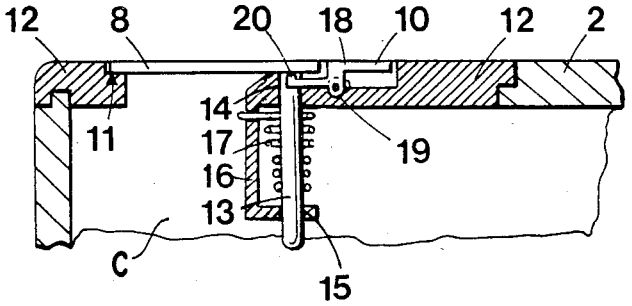
FIG.3

COVER FOR A LOOP CATCH MECHANISM OF A SEWING MACHINE

BACKGROUND OF THE INVENTION

Most known sewing machines comprise in their lower base or arm a loop catch machanism located beneath a removable cover which often comprises a shiftable plate. The cover is normally engaged in a housing of a base plate forming a part of the machine working surface but must be removed or shifted away from the housing when it becomes necessary to gain access to the loop catch mechanism such as when servicing or replacing the bobbin contained therein. Two examples of prior cover devices for sewing machine loop catch mechanisms will be found in U.S. Pat. No. 3,530,812 issued 9/29/70 to Rouha and French Pat. No. 738,724 issued 12/29/32 to Gonyk. Both of these devices employ a cover supported upon a spring-urged pivot pin but require a decided effort by the user's fingers to manipulate the cover.

The present invention has as its object facilitating the opening and closing operation of this cover for the user.

For this purpose, the sewing machine according to the invention is characterized in that the cover is connected to a lower arm base plate by a pin device comprising a swivel pin approximately perpendicular to the cover plate and which passes near a portion of the periphery of the cover, thereby allowing a sliding and arcuate displacement of the cover about the swivel pin. An elastic return element pulls the cover toward the inside of the base plate housing, while a manual control element allows movement of the cover against the action of the return element to remove the cover from its housing.

The accompanying drawing shows diagrammatically and by way of example an embodiment and a variant of the machine that is the object of the invention.

BRIEF DESCRIPTION OF THE DRAWING

FIG. 1 is a front elevation of a sewing machine incorporating the present invention;

FIG. 2 is a plan view, on a larger scale, of the end of the lower arm of this machine;

FIG. 3 is a section along line III—III of FIG. 2;

DESCRIPTION OF THE PREFERRED EMBODIMENTS

Figure 4:
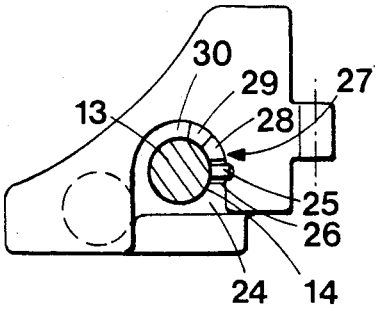
FIG. 4 is a plan view of a detail of the pin device of the variant.

The machine shown in FIG. 1 consists in a standard way of a base 1 supporting a lower arm 2 and a column 3 carrying an upper arm 4, at the end of which is a needle bar 5.

As FIG. 2 shows, the upper face of free arm 2 carries a small plate 6 that covers the mechanism of the feeding device whose feed dog 7 can be seen while a cover 8 equipped with a transparent window 9 covers access to a cavity C adapted to contain a loop catch mechanism designated L. The opening of this cover 8 is controlled by simple pressure on a control button 10. As far as the present invention is concerned, the specific structure of the loop catch mechanism L is immaterial as any well known such mechanism may be located within the cavity C.

As is seen in FIG. 3, cover 8 consists of a plate which is engaged in a housing 11 provided in a base plate 12.

Cover 8 is connected to a base plate 12 by a pin device whose swivel pin is approximately perpendicular to the plate of the cover and passes near a portion of the periphery of the cover. This pin device enables a sliding displacement of the cover along its swivel pin. For this purpose, a pin 13 is solid with or fixedly connected to the cover 8 and two bores or bearings 14 and 15 provided in base plate 12 and respectively in a bracket-shaped part 16 which is solid with this plate 12. Pin 13 can thus turn and slide in bores 14 and 15.

Pin 13 is subjected to the action of an elastic return element including a helical spring 17 which acts simultaneously in compression and in torsion. The turns of its lower end have a smaller diameter than that of the pin, so as to grip the pin in a fixed, frictional manner. The upper part of the spring exhibits turns spaced between one another and whose inside diameter is larger than that of the pin. The upper end of the spring rests against base plate 12 to exert an axial thrust on the pin directed downward and against bracket-shaped part 16 to exert a torsion on the pin that tends to open cover 8 in the direction of arrow f of FIG. 2.

To open cover 8, it must be disengaged from within the housing 11 of plate 12. This is performed by a lever 18 hinged by a pin 19 on plate 12 and having one end constituting a button 10, while its other end forms a nose 20 that rests against the lower face of cover 8, in the immediate vicinity of pin 13. A pressure exerted on button 10 causes lever 18 to rock and lifts cover 8 against the action of spring 17. As soon as the cover is disengaged from its housing, the torsion exerted by spring 17 on the pin causes the cover to turn to open the access to the bobbin.

As shown in FIG. 2, a stop 21 solid with lower face 8 is intended to work with an edge 22 of the housing provided in plate 12 to determine the opening angle of cover 8.

A boss 23 solid with the cover or with the edge of the housing serves to fix the closed position of the cover so as to obtain the parallelism between the edges of the cover and those of the housing.

Figure 5:
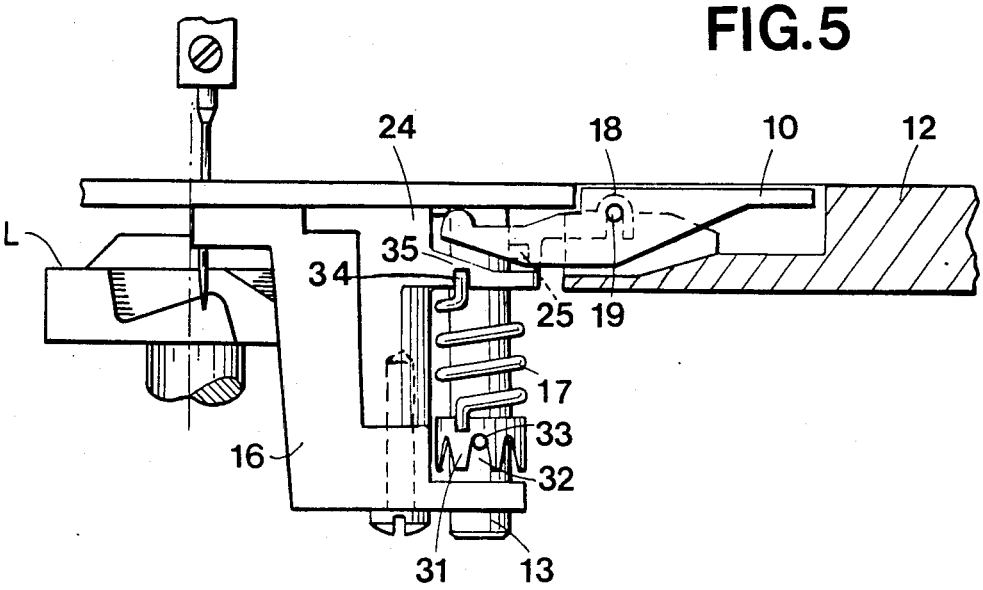
FIG. 5 is a view in partial section of this pin device.

FIGS. 4 and 5 show a variant embodiment which allows a greater ease of adjusting the torque exerted by spring 17.

The lower end of pin 13 is again engaged in a bearing of part 16. On the other hand, the upper part of this pin turns and slides in a plastic part 24, which is screwed on part 16. As FIG. 4 shows, pin 13 carries a lug 25 which is engaged in a notch 26 of part 24, in closed position of cover 8.

A ramp mechanism makes it possible during the opening movement to keep the lower face from rubbing against the upper edge of plate 12. For this purpose, part 24 exhibits an arc-shaped ramp 27 providing a plurality of slopes formed by a first portion 28 of slight slope or inclination, then by a second portion 29 of sharper slope or inclination and finally by a third portion 30 at still another slope preferably comprising zero inclination. When button 10 is pressed, lug 25 is first of all disengaged from its notch 26 and at this moment the inside face of cover 8 has been raised above the level of the upper face of plate 12. Under the action of the torsion spring, lug 25 works with slight ramp 28, which allows an easy acceleration of the rotation movement of cover 8. Then lug 25 must cross ramp 29 to arrive on portion 30, which brakes the rotation movement slightly.

The lower end of spring 17 is engaged in a notch of a ring 31 exhibiting notches 32 to be held by a pin 33 of pin 13. Upper end 34 of spring 17 is engaged in a notch 35 of part 24. This arrangement makes possible an easy adjustment of the initial torsion of spring 17, by raising ring 31 to disengage it from lug 33 and after selecting another notch 32, allowing the ring notch to engage the lug 33.

We claim:

1. A sewing machine comprising in its lower arm a loop catch mechanism located beneath a cover formed by a displaceable plate allowing access to the loop catch mechanism, the cover normally being engaged within a housing of a base plate forming a part of the working surface of the lower arm, the cover being connected to the base plate by a pin device providing a swivel axis approximately perpendicular to the plane of the cover and which passes near a portion of the periphery of the cover, the pin device permitting sliding of the cover along the pin device swivel axis, characterized in that said sewing machine includes an elastic return element urging said cover toward the inside of said housing, manual control means operable to move said cover against the action of said return element to remove said cover from said housing, said pin device including ramp means controlling axial movement of said cover as it is removed from said base plate housing and allowing said cover to swivel into an open position angularly displaced from said housing.

2. A sewing machine according to claim 1 including stop means between said base plate and said cover to fix the open position of said cover without the edges of said cover being in contact with the edge of said housing.

3. A sewing machine comprising in its lower arm a loop catch mechanism located beneath a cover formed by a displaceable plate allowing access to the loop catch mechanism, the cover normally being engaged within a housing of a base plate forming a part of the working surface of the lower arm, the cover being connected to the base plate by a pin device providing a swivel axis approximately perpendicular to the plane of the cover and which passes near a portion of the periphery of the cover, the pin device permitting sliding of the cover along the pin device swivel axis, characterized in that said sewing machine includes an elastic return element urging said cover toward the inside of said housing, manual control means operable to move said cover against the action of said return element to remove said cover from said housing, said pin device including ramp means controlling axial movement of said cover as it is removed from said base plate housing and allowing said cover to swivel into an open position angularly displaced from said housing, and said return element including a spring exerting a torque on said cover to urge it to swivel to its open position.

4. A sewing machine according to claim 3 wherein said ramp means provides variable inclinations respectively engaged during swivelling of said cover to said open position, said inclinations including a first engaged inclination of slight slope followed by a second engaged inclination of a sharper slope in turn followed by a third engaged inclination of an approximately zero slope so that during opening of said cover the cover is far disposed from the base plate.

5. A sewing machine according to claim 3 wherein said manual control means comprises a lever hinged on a portion of said base plate, said lever having one end resting against the lower face of said cover and having another end constituting a button whose outside surface is located approximately in the plane of the upper face of said base plate.

6. A sewing machine according to claim 5 wherein the lower face of said cover exhibits a projecting portion forming a stop to stop said plate in its open position against the action of said spring.

7. A sewing machine comprising in its lower arm a loop catch mechanism located beneath a cover formed by a displaceable plate allowing access to the loop catch mechanism, the cover normally being engaged within a housing of a base plate forming a part of the working surface of the lower arm, the cover being connected to the base plate by a pin device providing a swivel axis approximately perpendicular to the plane of the cover and which passes near a portion of the periphery of the cover, the pin device permitting sliding of the cover along the pin device swivel axis, characterized in that said sewing machine includes an elastic return element urging said cover toward the inside of said housing, manual control means operable to move said cover against the action of said return element to remove said cover from said housing, said pin device including ramp means controlling axial movement of said cover as it is removed from said base plate housing and allowing said cover to swivel into an open position angularly displaced from said housing, and said elastic return element comprising a single spring arranged to exert an elastic moment both pulling said cover into said open position and an axial force pulling the cover toward the inside of said housing.

8. A sewing machine according to claim 7 wherein said pin device includes a pin mounted to slide in a bearing in said base plate, said spring comprising a helical spring, said pin disposed inside said helical spring, whereby said spring performs the functions of both an axial spring to pull the cover into said housing and of a torsion spring to pull the cover into said open position.

* * * * *